US005804043A

United States Patent [19]

Ikegaya

[11] Patent Number: 5,804,043

[45] Date of Patent: Sep. 8, 1998

[54] SURFACE TREATMENT DEVICE

[75] Inventor: Hirohiko Ikegaya, Iwata, Japan

[73] Assignee: Yamaha Hatsudoki Kabushiki Kaisha, Iwata, Japan

[21] Appl. No.: 593,494

[22] Filed: Jan. 30, 1996

[30] Foreign Application Priority Data

Feb. 2, 1995 [JP] Japan ..... 7-016087

[51] Int. Cl.[6] ..... C25D 5/02; C25D 17/00

[52] U.S. Cl. ..... 204/224 R; 204/272; 204/275; 204/269; 118/317; 118/423

[58] Field of Search ..... 204/272, 269, 204/224 R, 275; 118/317, 423

[56] References Cited

U.S. PATENT DOCUMENTS

| | | | |
|---|---|---|---|
| 3,746,632 | 7/1973 | Kühdorf et al. | 204/275 X |
| 4,303,481 | 12/1981 | Mortier et al. | 204/269 X |
| 4,441,976 | 4/1984 | Iemmi et al. | 204/224 M |
| 5,069,760 | 12/1991 | Tsukamoto . | |

FOREIGN PATENT DOCUMENTS

| | | |
|---|---|---|
| 825071 | 2/1938 | France . |
| 2102836 | 2/1983 | United Kingdom . |
| 2192642 | 1/1988 | United Kingdom . |

*Primary Examiner*—Donald R. Valentine
*Attorney, Agent, or Firm*—Knobbe, Martens, Olson & Bear LLP

[57] ABSTRACT

A surface treating device for applying a surface treatment through the use of a fluid to the cylinder bores of a wide variety of types of cylinder blocks. The apparatus includes a cylinder block mounting arrangement that has flow paths formed in it that are adapted to accommodate a wide variety of types of cylinder blocks and cylinder blocks having different cylinder numbers and different cylinder bore diameters. Improved flushing and fluid recovery systems are also disclosed.

9 Claims, 10 Drawing Sheets

SURFACE TREATMENT DEVICE

BACKGROUND OF THE INVENTION

This invention relates to a surface treatment device and more particularly to an improved device for chemically treating the cylinder bores of a wide variety of types of cylinder blocks.

It has been proposed to provide an apparatus wherein the cylinder blocks of internal combustion engines can be formed from a light alloy material. Rather than employing conventional liners for the cylinder bores, a plating process is employed where a desired wear-resistant plating or surface is formed on the surface of the light alloy casting which defines the cylinder bore. This type of apparatus permits the formation of lightweight, low-cost, high-strength and high wear-resistant cylinder blocks.

The normal treating process for these platings employs a series of fluid treatments that are performed on the cylinder blocks. These treatment generally include at least a degreasing station, a preliminary treatment station, a plating station, and a flushing station. In at least some of these stations and primarily the plating station, the cylinder blocks are held on a fixture and a tubular electrode is passed into the cylinder bores.

A fluid is circulated in the area between the cylinder bores and the outer periphery of the electrode. The inner periphery of the electrode forms one fluid path and the outer peripheral area forms another fluid path through which the liquid is circulated at a high velocity. The electrode is charged with one polarity while the cylinder block is charged with an opposite polarity and the plating material is thus deposited on the cylinder bore surface.

With this type of arrangement it is obviously necessary to support the cylinder blocks in a fixed and sealed position. The electrode must pass concentrically through the cylinder bore and define a relatively narrow gap between its outer peripheral surface and the inner peripheral surface of the cylinder bore. Both ends of the cylinder bore are generally sealed so that the fluid can flow in the desired flow path. As has been noted, this method and apparatus permits the formation of lightweight, high-quality cylinder blocks from light alloy materials.

However, although the apparatus permits high quality and also high-speed plating, the apparatus previously employed have been designed for a particular cylinder block and one having particular cylinder bore pitches and specific cylinder bore diameters. In other words, the previously proposed apparatus have not been capable of simple adaptation to a wide variety of cylinder blocks or even cylinder blocks having slightly different bore pitch or bore diameter.

It is, therefore, a principal object of this invention to provide an improved surface treating arrangement for the cylinder bores of cylinder blocks that is more versatile in construction.

It is a further object of this invention to provide an improved cylinder block surface treating arrangement wherein the cylinder bore surfaces of a wide variety of types of cylinder blocks having different cylinder bore numbers and pitches as well as bores may be traded with a minimum of down time.

SUMMARY OF THE INVENTION

This invention is adapted to be embodied in a surface treating device for applying a surface treatment employing a fluid to the cylinder bores of a wide variety of cylinder blocks. The device is comprised of a base having fluid inlet port means for delivering the treating fluid and fluid outlet port means for discharging the utilized treating fluid. At least one of the port means is comprised of a plurality of ports and flow control means for selectively controlling the flow therethrough. The ports of the plurality extend through a base plate portion of the base. A detachable adaptor plate is adapted to be affixed in abutting relationship with the base plate and has a plurality of flow openings therethrough which extend from an electrode receiving surface thereon to selective of the ports for establishing a flow relationship therewith. The flow openings are spaced from each other in the electrode-receiving surface in a pitch corresponding to the pitch between the cylinder bores of the cylinder blocks to be surface treated. A cylinder block mounting plate is fixed in spaced relationship to the adaptor plate and is adapted to support one face of a cylinder block with the cylinder bores in alignment with the flow openings in the electrode receiving surface of the adaptor plate.

DETAILED DESCRIPTION OF THE PREFERRED EMBODIMENTS OF THE INVENTION

Figure 1:
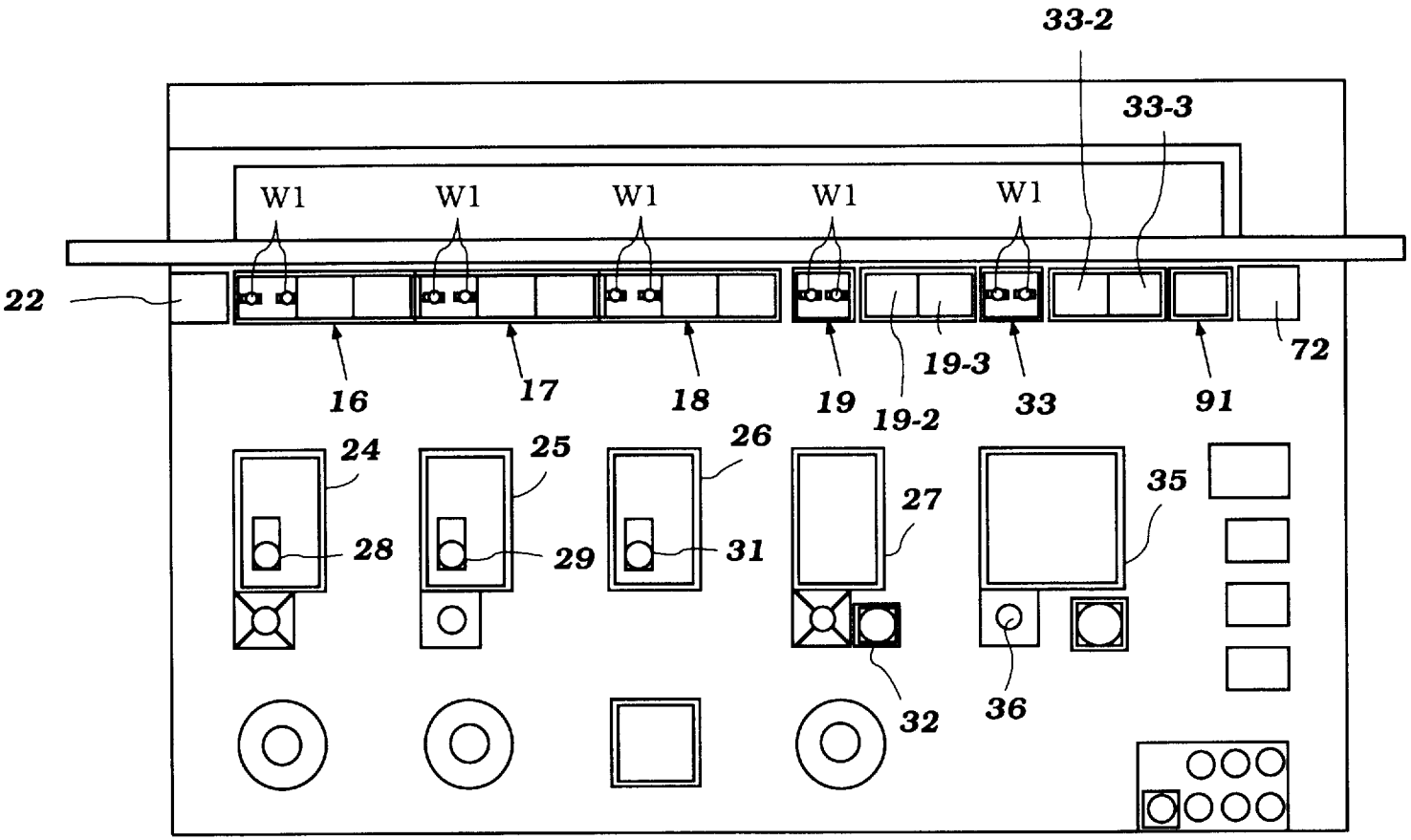
FIG. 1 is a top plan view showing a plating line constructed in accordance with a first embodiment of the invention and showing how the apparatus can be employed for plating the cylinder bores of single cylinder two cycle engines.

Referring now in detail to the embodiment of FIGS. 1–4 and initial primarily to FIG. 1, a factory or work station wherein a plating process practiced in accordance with a first embodiment of the invention is illustrated in top plan view and in partially schematic form. In this embodiment, the apparatus is set up to simultaneously plate two separate light alloy cylinder blocks for two cycle, internal combustion engines. These cylinder blocks are indicated generally by the reference character W1.

Figure 2:
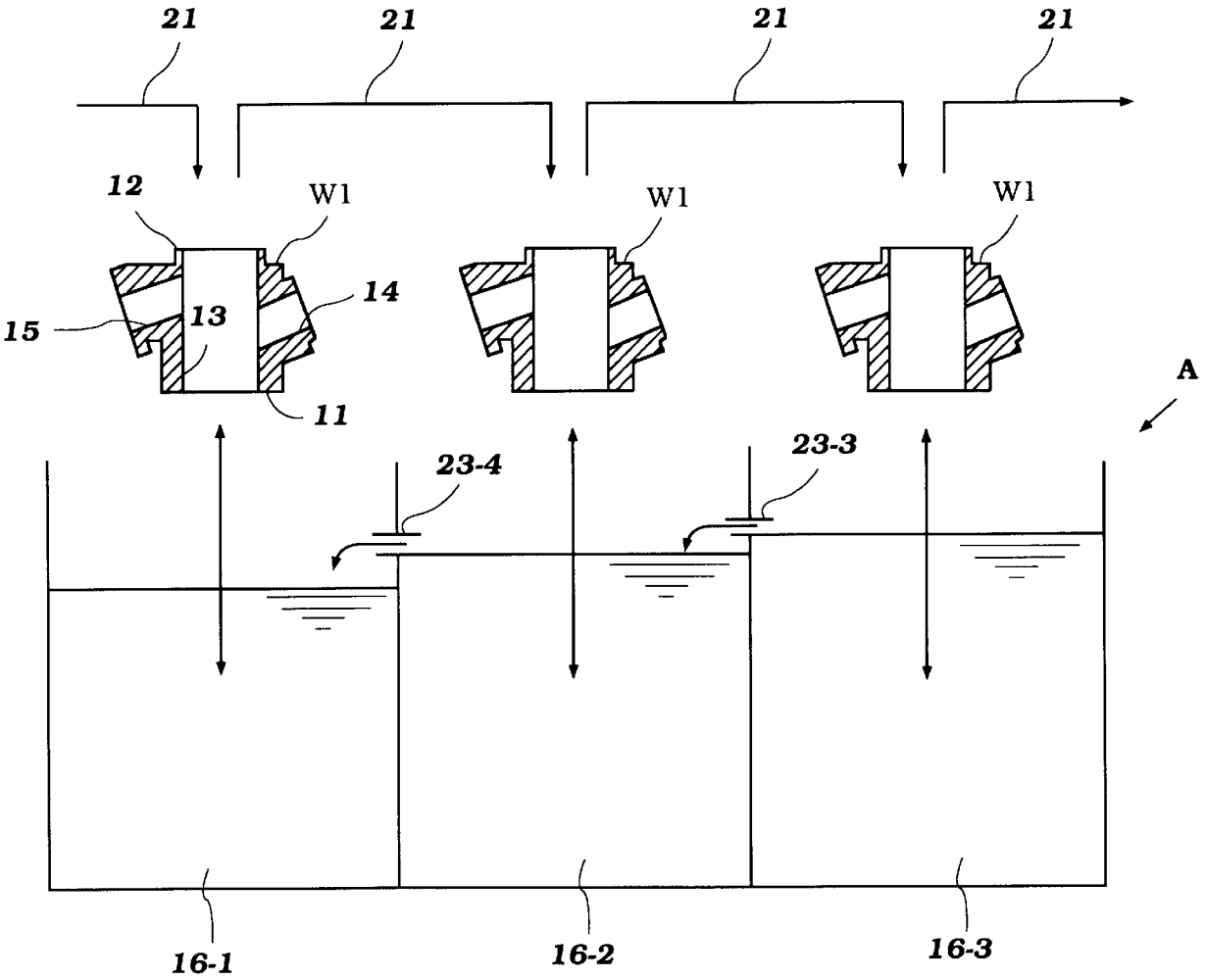
FIG. 2 is an enlarged cross-sectional view showing one of the treating stages of the apparatus, this being the degreasing stage in the illustrated embodiment.
Figure 3:
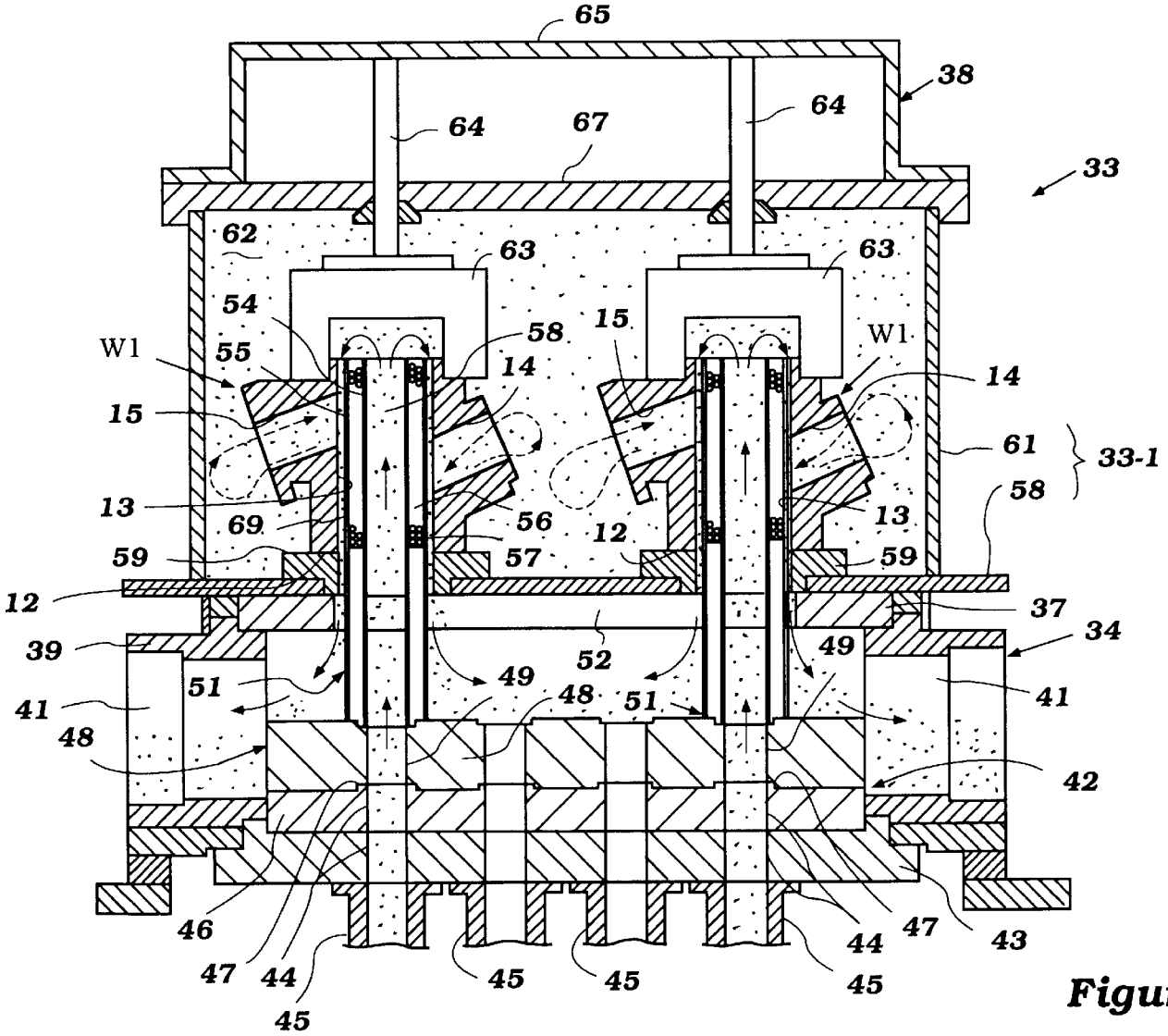
FIG. 3 is a cross-sectional view taken through the plating bath and shows the apparatus constructed in accordance with a first embodiment of the invention set up for plating two single cylinder two cycle engine cylinder blocks.

These cylinder blocks have a configuration as generally shown in FIGS. 2 and 3 and are comprised of a main cylinder block casting W1 which may be formed from a lightweight metal such as aluminum or aluminum alloy. The cylinder block W1 as cast and finished for plating has a lower surface 11 that is adapted to mate with an associated crankcase member and an upper surface 12 that is adapted to mate with a cylinder head in the finished engine.

A cylinder bore 13 is formed which may have been bored and rough-machined to a diameter close to the final finish diameter, with allowance being made for the plating material to be deposited. Extending through the sides of the cylinder block W1 are scavenge ports or passages 14 and exhaust scavenge ports or passages 15. The actual construction of the engine and the detailed construction of the cylinder block W1 is not important to permit those skilled in the art to practice the invention. Those skilled in this art will readily understand how the invention is practiced in conjunction with a wide variety of types of cylinder blocks, certain of which will be described in this and subsequent embodiments.

Referring now specifically to FIG. 1 again, the plating process includes a plurality of treating stations which are comprised of, in the illustrated embodiment, a degreasing station 16, an alkali etching treatment section 17, and a mixed acid etching section 18. The sections 16, 17, and 18 are pretreatment stations that precede an aluminide treatment section 19. In the illustrated embodiment, each section 16, 17, 18, and 19 is comprised of a plurality of treatment tanks or stations.

FIG. 2 shows the treatment tanks associated with the degreasing section 16. As may be seen in FIG. 2, the degreasing station 16 includes a first tank 16-1 in which a degreasing fluid is contained and in which the cylinder block castings W1 are immersed for their initial degreasing. A conveyor section, indicated schematically by the arrows 21 in FIG. 2, is provided for moving the cylinder blocks W1 along the line. These cylinder blocks are initially delivered to a delivery station 22 (FIG. 1) disposed before the first tank of the degreasing section 16-1.

It should also be noted that when treating single cylinder two-cycle engine blocks W1, the conveyor apparatus is designed so as to handle two such cylinder blocks W1 at each time. Hence, two cylinder blocks are put in the first degreasing tank 16-1 and then moved along the line in the path to be described.

From the tank 16-1, the cylinder blocks are immersed in a fluid recovery tank 16-2 where the remaining degreasing fluid is recovered. The cylinder blocks W1 then are immersed into a water washing tank 16-3.

As may be seen in FIG. 2, the tanks 16-1, 16-2, and 16-3 have staggered depths, with each tank having a respective drain or overflow opening 23-3 and 23-4 which feeds the overflow from the tank 16-3 into the tank 16-2 and which feeds the overflow from the tank 16-2 into the tank 16-1.

Referring again to FIG. 1, adjacent each of the fluid treating stations, including those which will be described later, there is provided a respective fluid storage tank.

These include a degreasing fluid storage tank 24, adjacent the degreasing section 16; an alkali fluid storage tank 25, adjacent the alkali treatment station 17; a mixed acid storage tank 26, adjacent the acid etching section 18 and an aluminide fluid storage tank 27 adjacent the aluminide treating station 19.

Respective pumps 28, 29, 31, and 32 are provided for exchanging the fluid between the storage tanks 24, 25, 26, and 27 and the treatment tanks 16-1, 17-1, 18-1, and 19-1 through suitable conduits and control arrangements. Since this portion of the line may be of any conventional type well known in this art, further description is not required to permit those skilled in the art to understand the invention.

Although the degreasing station 16, alkali etching station 17, and mixed acid etching section 18 are merely dip tanks, the tank 19-1 of the aluminide treatment tank is different and is constructed so as to channel a high-velocity flow of treating fluid into proximity with the cylinder bores 13. The apparatus utilized in this section may be the same as or similar to that utilized in the actual plating section, indicated generally by the reference numeral 33, and will be described by particular reference to that section.

Following the aluminide treating tank 19-1, there is a fluid recovery tank 19-2 and a water washing tank 19-3, which tanks 19-2 and 19-3 are dip tanks like those which preceded the station 19-1.

The plating tank 33-1 and the apparatus which forms it is illustrated in most detail in FIG. 3 and will be described primarily by reference to that figure. However, certain of the components also appear in FIG. 4, and when those components are described, reference may be had additionally to that figure.

Basically, the plating tank 33-1 and the apparatus which is associated with it includes a generally standard base section, indicated generally by the reference numeral 34, into which the treating fluid is delivered and from which it is returned and exchanged with the plating storage tank 35 (FIG. 1). Like the other stations, a pump 36 is provided for exchanging fluid between the plating fluid storage tank 35 and the base section 34. This circulation will be described later.

The upper portion of the base section 34 is comprised of an apparatus which forms the tank 33-1 and which includes a mounting plate 37 upon which the cylinder blocks W1 are mounted in a manner to be described. A holding fixture, indicated generally by the reference numeral 38, is associated at the upper end of the plating fluid tank 33-1 and cooperates with the cylinder blocks W1 to hold them in position and to provide a fluid seal therewith so as to control the fluid flow in a manner which will be described.

Figure 4:
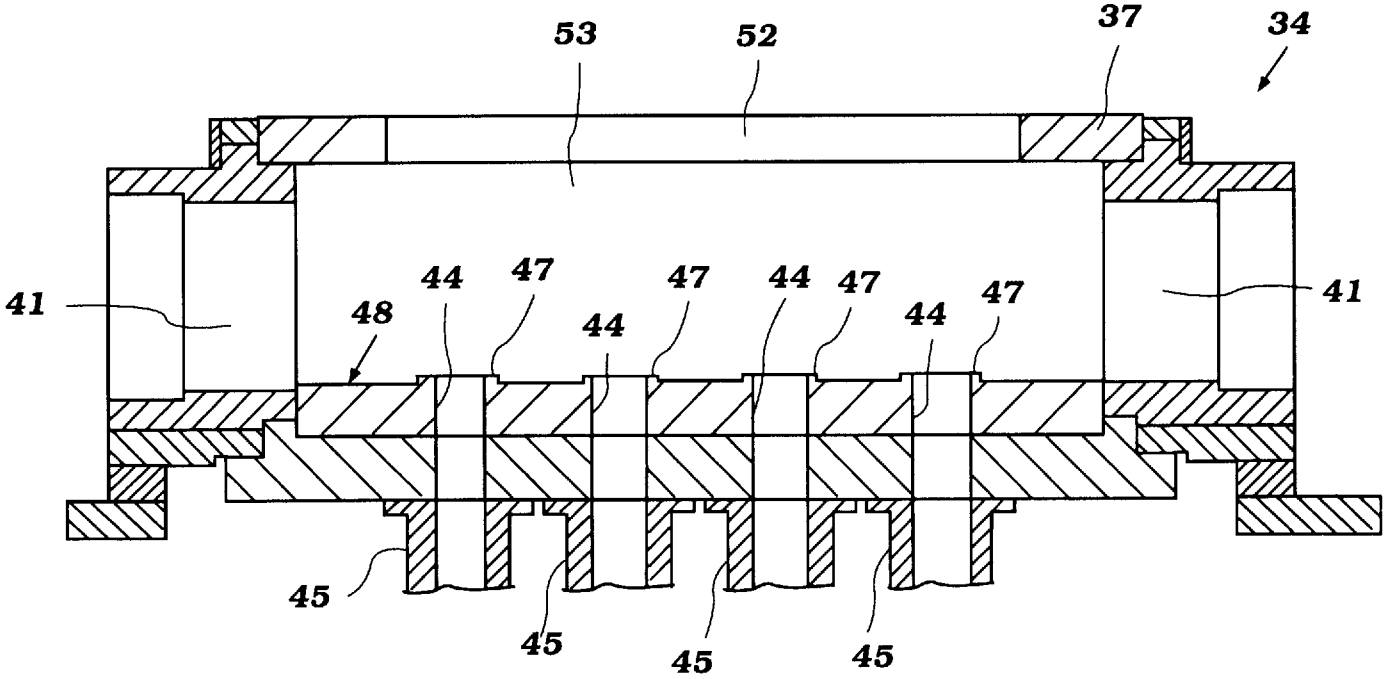
FIG. 4 is an enlarged cross-sectional view of a portion of the apparatus shown in FIG. 3 and shows how the base plate is constructed.

The base portion 34 and its construction will now be described by primary reference to FIGS. 3 and 4. The base portion 34 includes a number of components which will now be described and which form the base 34 for all cylinder blocks which may be treated, as will become apparent. This base 34 includes an outer housing piece 39 that defines a pair of fluid outlet fittings 41. Although two fluid outlet fittings are depicted, the actual number of such outlet fittings may vary, depending upon the particular application. Also the flow direction may be reversed, as will also become apparent.

The outlet fittings 41 communicate with a manifold (not shown) for returning the plating fluid to the storage tank 35.

The lower end of the housing 39 is closed by means of a base plate assembly, indicated generally by the reference numeral 42. This base plate 42 is comprised of a first underplate 43 in which a plurality of fluid admission openings 44 are formed. Each opening 44 is served by a respective fluid manifold 45 which is provided with a control valve (not shown) and which communicates with the outlet of the pump 36 through these control valves.

By operating the control valves, as will be described, the ports 44 of the base plate 43 may be selectively enabled or disenabled. The number of ports 44 chosen will be determined by the number of cylinder bores which are to be treated.

Supported on the underplate 43 and forming a part of the base plate assembly 42 is an adaptor plate 46. The adaptor plate 46 forms extensions of the fluid inlet ports 44. These extended fluid inlet ports 44 terminate in an upper surface thereof which is formed with adaptor portions 47 that encircle each of the fluid inlet ports 44.

These adaptor portions 47 cooperate with a replaceable adaptor plate, indicated by the reference numeral 48, and which, in turn, has ports 49 that extend from the ports 44 to an upper surface of the adaptor plate 48 that is adapted to mount tubular electrodes. These tubular electrodes are indicated generally by the reference numeral 51. The electrodes 51 may be suitably connected to the adaptor plate 48.

It should be noted that the spacing of the openings 49 in the upper surface of the adaptor plate 48 corresponds to the bore pitch of the cylinder bores to be plated. In this instance, since two cylinder blocks W1 are being plated at the same time, there are only two active adaptor plates passages 49, and these cooperate with a pair of electrodes 51 that are spaced at a pitch corresponding to the pitch at which the conveyor 21 presents the cylinder blocks W1 to the tank 33-1.

In view of the fact that only two cylinder bores are being treated, the valves associated with the center to fluid delivery conduits 45 will be closed, and no fluid can flow through these conduits in either direction.

It should be noted that the cylinder block supporting plate 37 has a relatively large upper opening 52 through which the electrodes 51 pass and which defines the upper periphery of a fluid chamber 53 that is in open communication with the discharge outlet ports 41. This chamber 53 forms generally a return chamber, as will become apparent.

Referring now in detail to the construction of the electrodes 51, they are comprised of an inner tube 54 and an outer tube 55 which are spaced apart and define a gap 56 there between. Pellets 57 for replacement of the plating material are loaded into these gaps. The upper ends of the tubes 54 and 55 are open, and the pellets of the anode material will not pass out of the open upper end because of the pressure of the plating fluid being circulated therethrough.

In this embodiment the tank 33-1 is formed by a lower plate 58 which is supported on the cylinder block supporting plate 37 and which mounts a pair of cylinder block fixtures 59 onto which the cylinder head sealing surfaces 12 of the cylinder blocks W1 are pressed in a manner to be described. In this way, there will be a fluid-tight seal established by the cylinder head surface 12 and the cylinder block mounting plates 59. An outer box-like enclosure 61 is affixed to the bottom plate 58 and completes the formation of the tank 33-1. This defines a fluid chamber 62 to which the electrolytic fluid will be delivered in a manner to be described.

The cover member 38 carries a pair of fixtures 63 which are held in place by posts 64 that are fixed to a hat-shaped upper cover piece 65 and pass through a lower cover piece 67. The lower cover piece forms a seal at the upper end of the cavity 62 with the outer box-like member 61. The fixtures 63 are configured so as to engage an appropriate area of the cylinder blocks W1, but leave the lower crankcase engaging surfaces 11 generally open.

As may be seen, the inner tubes 54 of the electrodes 51 form a fluid path 68 that registers with the fluid path 49 formed in the adaptor plate 48, and thus receives the fluid delivered from the conduits 45, which flows upwardly in the direction of the arrows shown in FIG. 3. This fluid then passes downwardly through a gap 69 formed by the area between the cylinder bores 13 and the outer surface of the outer electrode tube 55. The fluid passes at a high velocity through this gap, which is important in the plating process.

Since the exhaust port or passage 15 and scavenge port or passage 14 are open, some of the plating fluid will also fill the cavity 62. This will only occur until the cavity 62 is completely filled with fluid, and then all of the fluid flowing will pass through the gap 69 and enter back into the chamber 53 of the base 34 through the opening 52 in the cylinder block mounting plate 34. This fluid is then returned to the tank through the fluid outlets 41, as previously described.

To complete the plating process, the electrode 51 is suitably charged so as to have a positive charge on it, and the cylinder block W1 is charged negatively. As a result, the plating fluid will cause deposits on the cylinder bore 13, and this plating occurs at a high rate, as is well known.

As has been previously noted, the aluminite treatment performed in the section 19 may be substantially the same, and therefore its description is not necessary and it may use a similar fixture.

After the plating has been completed in the tank 33-1, the cover fixture 38 is removed, and the cylinder blocks W1 are moved first to a fluid recovery tank 33-2 and then to a washing tank 33-3.

From these tanks, the cylinder blocks W1 are then moved to the drying area 71, where the cylinder blocks are dried before being moved by the conveyor 21 to the finished workpiece table 72 where the cylinder blocks 71 may be removed.

Figure 5:
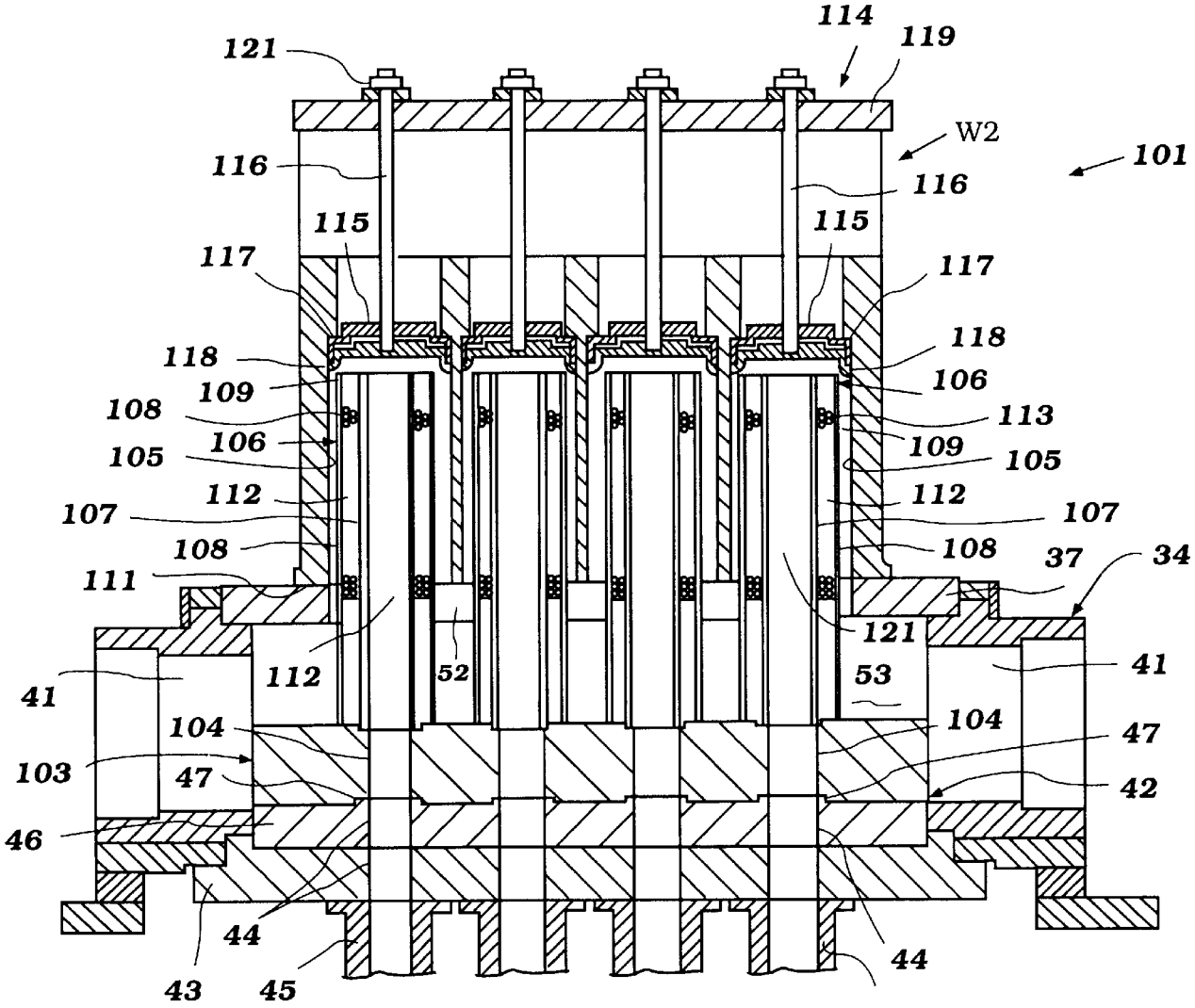
FIG. 5 is a cross-sectional view, in part similar to FIG. 3, but shows how the apparatus can be set up for plating the cylinder block of a four cycle, four cylinder engine.

FIG. 5 shows another embodiment of the invention and illustrates how the apparatus can be employed with an engine of quite different type with a minimum change in tooling and equipment. The plating station is indicated in this figure generally by the reference numeral 101, while the cylinder block, which comprises a four cylinder in-line four cycle engine is indicated by the reference character W2. It will be seen that the base 34 is substantially the same as the base plate utilized with the previously described embodiment, and for that reason, the components that are the same are identified by the same reference numerals.

In this embodiment the adaptor plate 48 of the previous embodiment is replaced by an adaptor plate 103 which has passages 104 which are aligned with the passages 44 in the base plate 43 and adaptor plate 46. The adaptor portions 47 of the adaptor plate 46 cooperate with base receiving portions of the adaptor plate 103 so as to provide a continuous fluid flow path there between.

It will be seen that the cylinder block W2 has four cylinder bores 105, each of which has a substantially larger diameter than the cylinder bores 13 of the previous embodiment. In addition, these cylinder bores 105 are all formed in a common cylinder block W2.

Therefore, this embodiment is provided with tubular electrodes 106 that are comprised of an inner tube 107 and an outer tube 108, both of which are larger than the diameters of the electrode 51 of the previous embodiment. In this particular embodiment, the bore spacing, or pitch, of the cylinder bores 105 is substantially the same as the pitch of the openings 44 and 104. Thus to accommodate this different cylinder block W2, all that is required is the provision of larger diameter electrodes so as to minimize the gap 109 that exists between the outer diameter of the outer tube 108 and the cylinder bore 105.

In this embodiment the cylinder block 82 is configured so that its upper sealing surface 111 is directly engaged and supported upon the cylinder block support plate 37. Also, since the cylinder bores in the cylinder block W2 have no ports that extend through them, a separate tank is not required. Hence the base plate 58 and side box 61 of the previous embodiment can also be dispensed with. Again, this is done without major change in the components.

The space between the inner tube 107 and outer tube 108, indicated by the reference numeral 112, is again provided with pellets 113 of the appropriate anode make-up material for the plating process. These dissolve into the plating fluid to make up the material that is deposited during the plating.

Since no plating tank is required, an arrangement consisting of a fixture, indicated generally by the reference numeral 114, is provided for effecting a seal at the base of the cylinder bores 115. This seal is effected by a first sealing cup shaped plate 115 which is slidably supported on a threaded rod 116. A second sliding plate 117 is affixed to the end of the threaded rod, and an O-ring seal 118 is loaded between the plates 115 and 117.

This assembly is mounted into the cylinder bores from the top, and then a base plate 119 is put in place through which the threaded rods 116 extend. By tightening nuts 121 on the threaded rods, the O-ring seals 108 are compressed and brought into sealing engagement at the lower ends of the cylinder bores 105.

Once the sealing jig 114 has been assembled to the cylinder block W2, the cylinder block and jig are positioned by the conveyor onto the supporting base 34, with the cylinder head surface 111 in engagement with and supported upon the cylinder block support plate 37. The plating liquid is then forced through tubular passages 122, formed by the inner tubes 107 of the electrodes 106, and flows to the area adjacent the upper end of the electrode where the seals 108 are positioned. This plating liquid then flows downwardly through the gaps 109 at a high velocity and is discharged through the opening 52 in the cylinder block support plate 37 back to the cavity 53 in the base for return to the plating fluid storage tank 35.

In this case, since there are four cylinder bores, all four valves associated with the inlet fittings 45 are open. Again, the electrodes 106 are provided with a negative charge, and the cylinder block W2 is provided with a positive charge so as to cause the plating material to be deposited thereupon.

Thus, from the description as thus far it should be readily apparent that the apparatus can be utilized to plate any number of cylinders, either in separate cylinder blocks or in one cylinder block, by controlling the number of fittings 45 which have their valves opened and which are associated with respective electrodes. In addition, different bore diameters can be accommodated by merely changing the adaptor plate 103 and the diameter of the tubes of the electrodes associated therewith.

Figure 6:
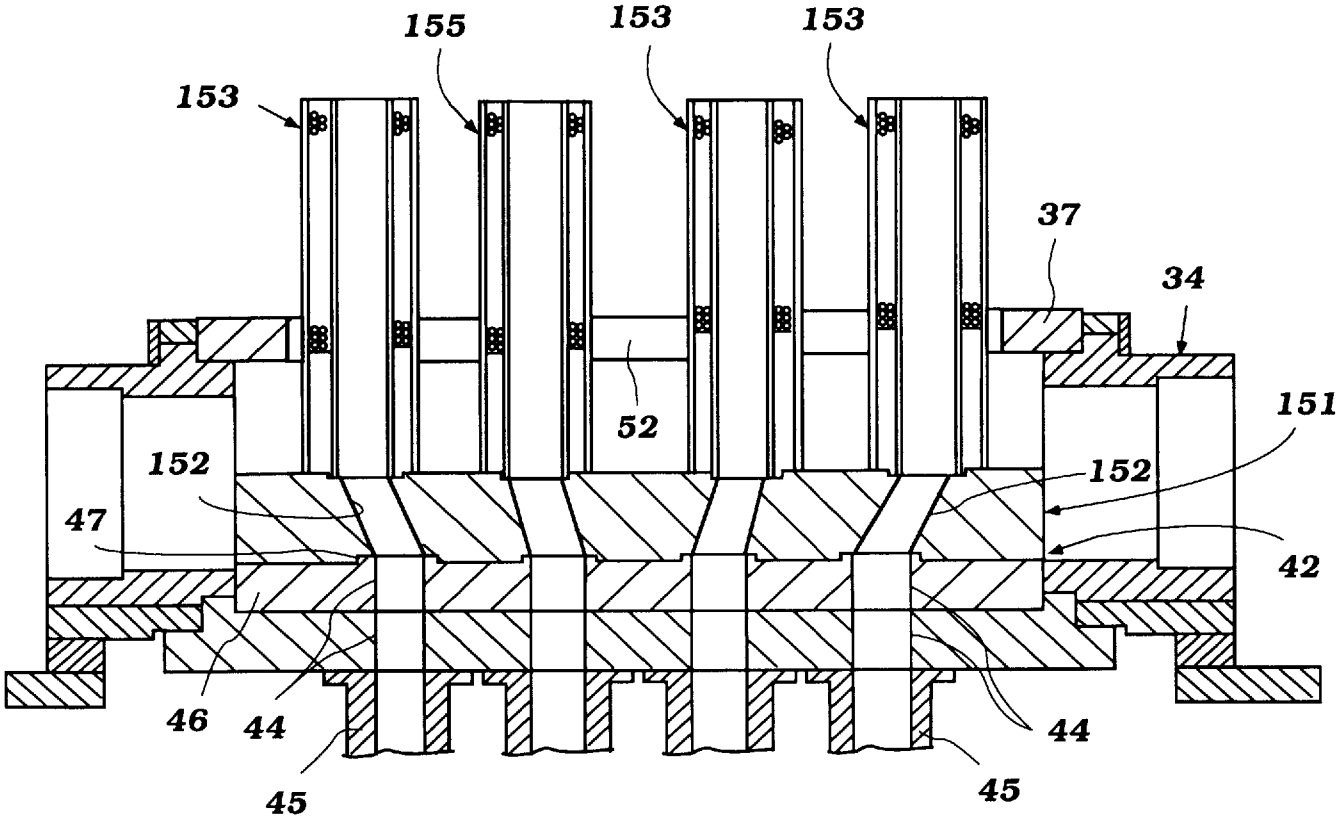
FIG. 6 is a partial cross-sectional view, in part similar to FIG. 5, and shows how the apparatus can be adapted to cooperate with a four cycle engine having a cylinder block having a bore pitch different from that shown in FIG. 5.

In the two embodiments thus far described, the pitch or bore spacing between the plated cylinder bores has been the same. FIG. 6 shows another embodiment of the invention wherein the same concept can be applied, but wherein the bore spacing is different. The construction shown in FIG. 6 accommodates a four-cylinder in-line engine, but it will be apparent to those skilled in the art how this embodiment and this concept can be employed with engines of other types and other cylinder numbers.

Again, the base plate assembly 34 is the same as those already described, and the only change required is the changing of the adaptor plate, indicated by the reference numeral 151 in this embodiment. In this embodiment the pitch between the cylinder bores of the cylinder block, which is not shown, is greater than that of the construction shown in FIG. 5. Hence, the adaptor plate 151 is provided with angularly disposed communication passages 152 that extend from the adaptor surfaces 47 of the adaptor plate 46 upwardly to electrodes 153. The electrodes 153 have a construction of the type previously described, and for that reason, further description of them is not believed to be necessary.

The diameter of the electrodes 153 is made complementary to the cylinder bores of the diameter of the associated cylinder block so as to maintain the desired relatively small flow path so that the fluid flowing therethrough will be at a high velocity. Again, different numbers of cylinders may be accommodated by shutting off the valves in the fluid supply passages 45.

Figure 7:
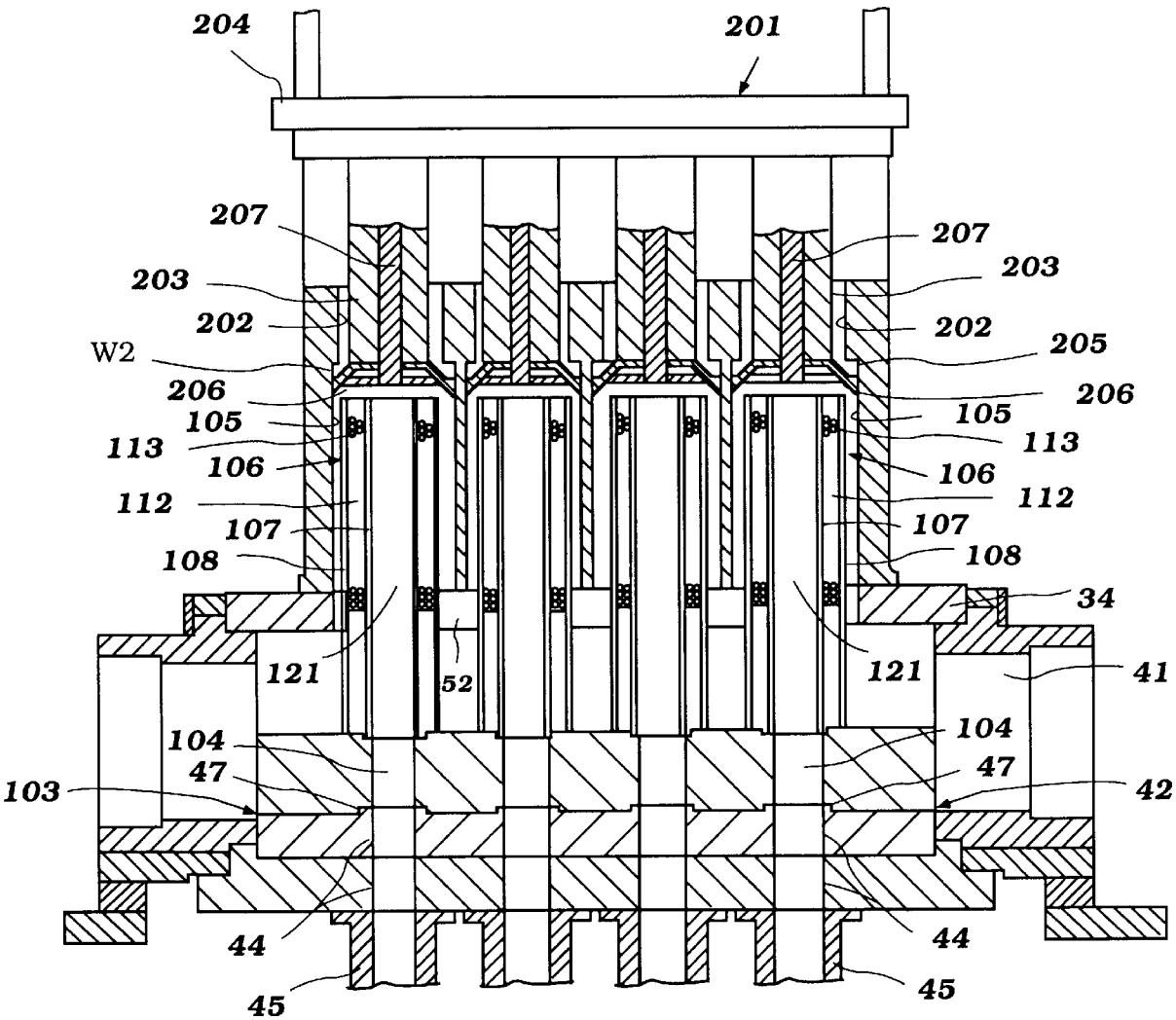
FIG. 7 is a cross-sectional view, in part similar to FIGS. 3 and 5 and shows another arrangement for sealing one end of the cylinder bores of a four-cycle engine and utilizing the apparatus.

FIG. 7 is another embodiment of the invention that is generally the same as those embodiments previously described. However, in this embodiment, which is again geared to a four-cylinder, four-cycle engine, a sealing fixture indicated by the reference numeral 201 is employed. Except for this sealing fixture, the construction has the same general configuration as that of FIG. 5, and for that reason, components of this embodiment which are the same as that embodiment are identified by the same reference numerals and will not be described again, except where necessary to understand the construction and operation of this embodiment.

As has been noted in describing the construction of the embodiment of FIG. 5, the fixture 114 of that embodiment required assembly to the cylinder block W2 before the cylinder block was placed onto the supporting base 34. The fixture 201 employed in the embodiment of FIG. 7 does not require this, but is constructed in such a way that it can be inserted into the cylinder block through the bottom end thereof. In this embodiment, the cylinder block W2 is formed with openings 202 that are below each cylinder bore and which are sized sufficiently so as to pass a cylindrical base part 203 of the fixture 201.

These cylindrical parts 203 are carried by a base plate 204 and depend a sufficient distance so as to be capable of passing through the cylinder block openings 202 so that resilient seals 205 carried thereby may collapse and pass through the openings 202 into the cylinder bores 105. Expansion members 206 are carried at the end of actuating rods 207 that are slidably supported within the cylindrical portions 203 and which are actuated by pneumatic or electrical servomotors (not shown). These expansion members 202 are movable between an expanded position as shown in FIG. 7, where they engage the seals 205 and urge them outwardly into sealing engagement with the cylinder bores 105. They are also movable to an intermediate position wherein the seals 205 will be initially brought outwardly and a further extreme position that permits the seals 205 to collapse like an umbrella upon insertion.

Hence, the fixture 201 is lowered, with the members 206 at this latter extreme position so that the seals 205 can collapse. Once initially inserted, movement of the members 206 upwardly toward the plate 204 is initiated. This causes the sealing members 205 to be deflected outwardly. Upon the final movement, the sealing members are held in sealing engagement with the cylinder bores 105.

This embodiment operates in its plating process like those previously described, and therefore, a further description of this embodiment is not believed to be necessary to permit those skilled in the art to practice the invention.

Figure 8:
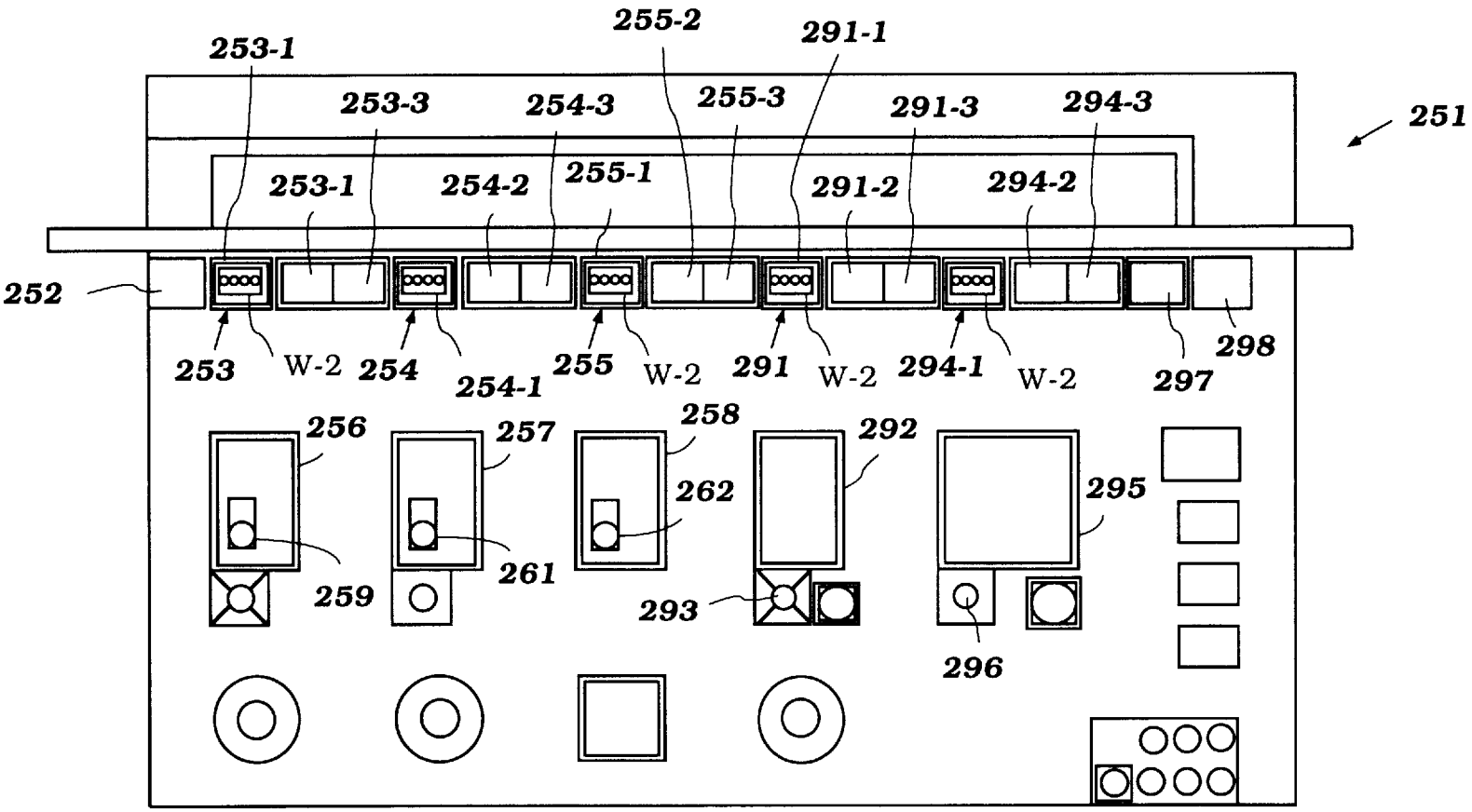
FIG. 8 is a top plan view, in part similar to FIG. 1, and shows the overall plating line for a four-cycle embodiment.
Figure 9:
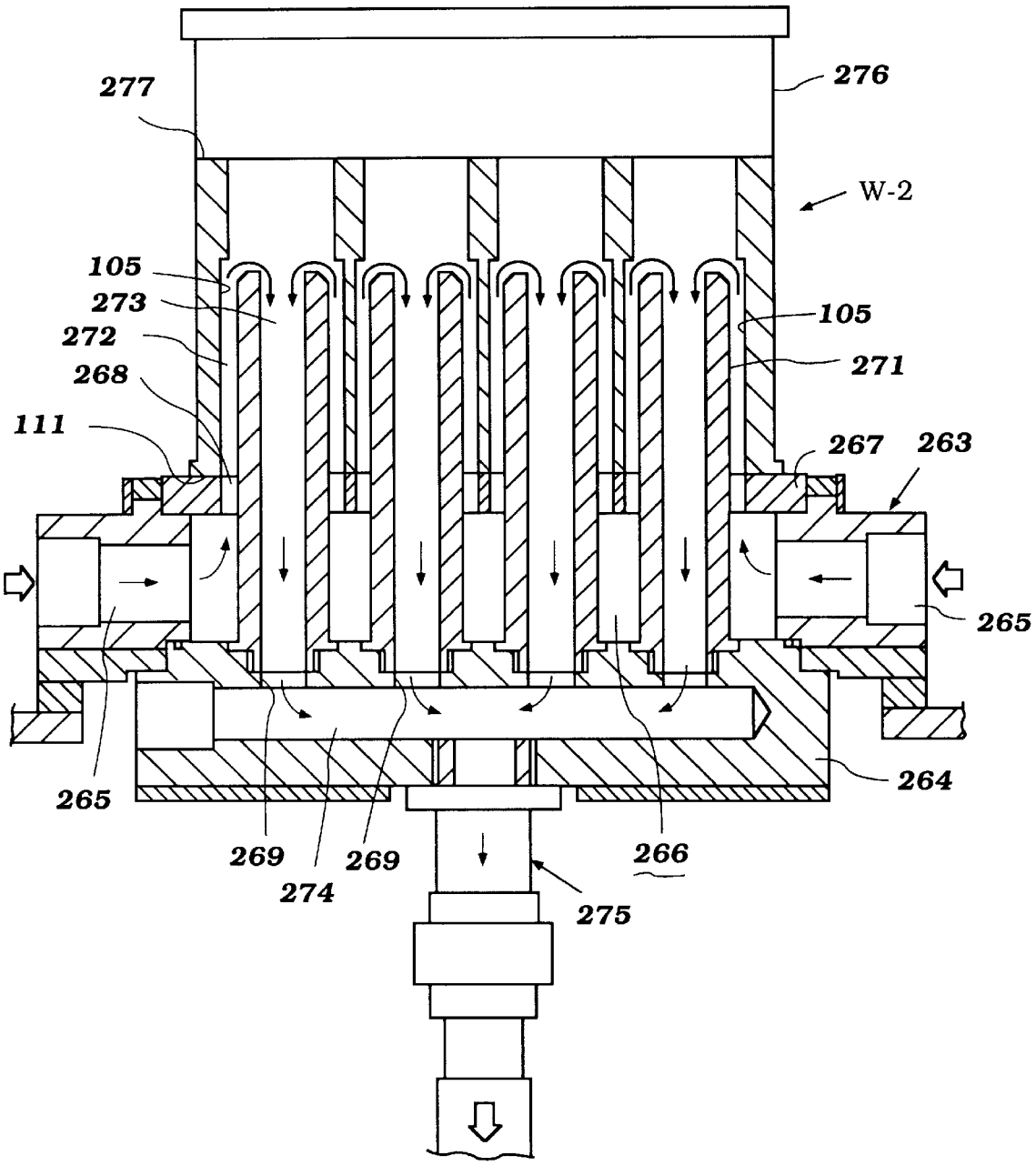
FIG. 9 is a cross-sectional view taken through the plating apparatus section of the embodiment shown in FIG. 8 and illustrates a still further embodiment of the invention.
Figure 10:
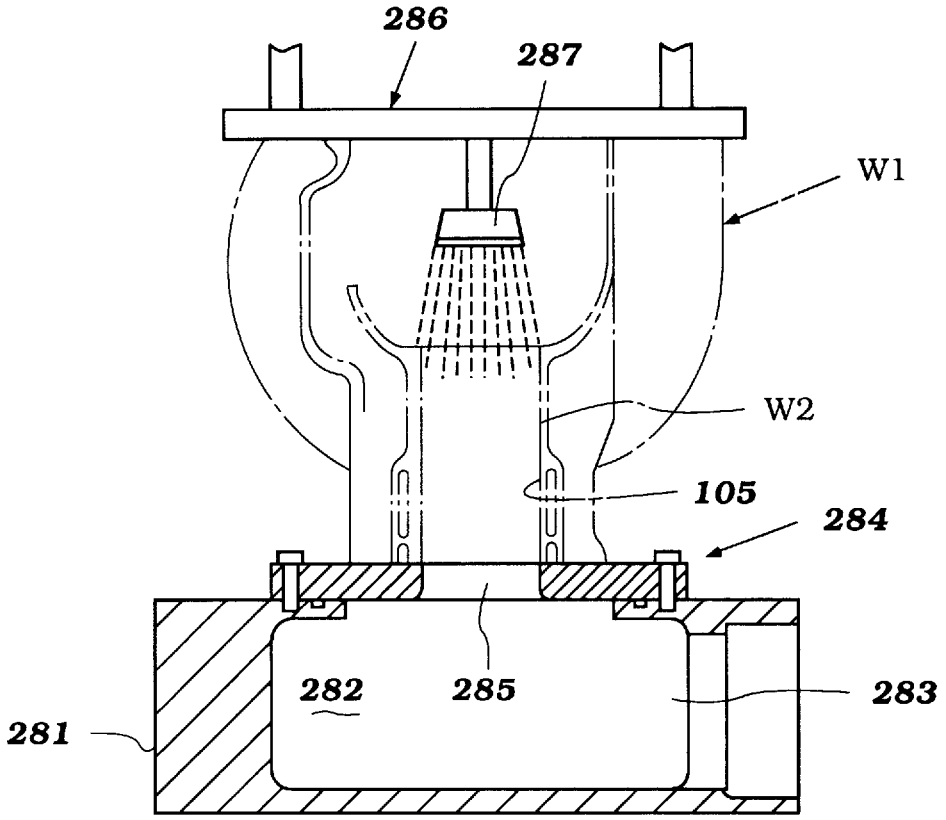
FIG. 10 is a cross-sectional view showing the washing stations of the embodiment of FIG. 8.

FIGS. 8–10 show another embodiment of the invention that utilizes a fixture very similar to that used for the plating section for performing some of the other surface treatment functions. In addition, this shows a reverse flow from the type previously described, and this reverse flow may also be employed in conjunction with the plating process.

A plating plant constructed in accordance with this embodiment is illustrated in FIG. 8 in a top plan view like FIG. 1 and is identified generally by the reference numeral 251. This embodiment is quite similar to the previously described embodiment, but different reference numerals will be applied to the construction.

The plant includes a workpiece delivery station 252 where workpieces are delivered for first treatment in a degreasing station 253. The degreasing station 253 includes the same three phases: the initial degreasing phase 253-1, a fluid recovery station 253-2, and a washing station 253-3. From the degreasing station, the cylinder blocks W2 are transferred to an alkali etching treatment station 254 which has the treatment tank 254-1, the fluid recovery tank 254-2, and the final washing station 254-3.

Next, the cylinder blocks W2 are transmitted to the mixed acid treating station 255, which again has the acid treating tank 255-1, the fluid recovery tank 255-2, and the washing tank 255-3.

Liquid for the degreasing, alkali etching, and mixed acid etching treatment stations are supplied from respective fluid tanks 256, 257, and 258. Suitable conduits and pumps 259, 261, and 262 transmit the fluids between the tanks, as aforedescribed. These tanks of each of the stations 253, 254, and 255 may be interrelated as shown in FIG. 2.

The structure employed in each of the tanks 253-1, 254-1, and 255-1 may have a construction as shown in FIG. 9. Because this construction is quite similar to that of the base of the previous constructions, it is believed that the description may be relatively abbreviated.

Each station includes a base portion 263 on which the cylinder blocks W2 are mounted, sealing surface 111 down, as with the previously described embodiments. The base 263 is comprised of a main housing portion 264 that is provided at its opposite ends with fluid inlet ports 265 which receive the fluid from the respective tanks 256, 257, and 258, depending upon the process being formed. This fluid is delivered to an internal cavity 266. This internal cavity is closed by a cover plate and cylinder block supporting member 267 which has a plurality of openings 268, one for each cylinder bore to be treated.

Fixed into the mounting base 264, and specifically in registry with fluid passages 269 thereof, are a plurality of tubes 271, one for each cylinder bore 105. These tubes 271 are fixed to the mounting base 264 and define a gap 272 between their outer surface and the cylinder bores 105 through which the processing fluid passes.

Each tube 271 has a central opening 273 that registers with the passages 269 so that the processing fluid may flow downwardly through the passages 269 to a return manifold 274 formed in the base plate 269. A return fitting 275 is connected to the base plate and opens into this return manifold 274 for collecting the processing fluid and returning it to the respective tank 256, 257, or 258. A fixture 276 engages the lower cylinder block surface, indicated by the reference numeral 277 in this figure, to seal the flow path.

FIG. 10 shows an embodiment that may be employed in the washing stations associated with the various treatment stations including the stations 253, 254 and 255 or, for that matter, with the embodiment of FIGS. 1–4.

This washing station has the advantage of minimizing the amount of water required and also the amount of space required since no dip tank is required. In addition, only the portion of the cylinder block W2 which has actually been treated need be washed since the treating fluids only contact primarily the cylinder bore 105. This same construction may also be utilized in the fluid recovery station.

In this arrangement, there is provided a base plate portion 281 having an internal cavity 282 in which the washing fluid may be collected for discharge through a discharge port 283 for return back to the respective tank. A plate 284 closes the upper end of the cavity 282 and supports the cylinder head engaging face of the cylinder block W2. The plate 284 has openings 285 each aligned with a respective one of the cylinder bores 105.

A fixture 286 is brought down into engagement with the skirt of the cylinder block and carries a spray head 287 that sprays primarily directly into the cylinder bore to 105. This obviously improves cleaning and reduces fluid treatment, as well be readily apparent.

This arrangement may also be utilized with a two cycle type cylinder block and such a cylinder block is shown in phantom at W1 in this figure to see how this system could be employed with it.

Referring again to FIG. 8, after the preliminary fluid treatments have been performed, the cylinder blocks W2 are transferred to the aluminide treating station, indicated generally by the reference numeral 291 and which includes the treating area 291-1, the fluid recovery area 291-2, and the washing area 291-3. These areas may be of the type previously described in any of the embodiments. The aluminide fluid is supplied from a supply tank 292 through conduit under pressure by a pump 293.

Finally, the plating section 294 also includes the plating tank 294-1, the fluid recovery area 294-2 and the washing area 294-3 which may be of any of the types thus far described. Fluid for the plating is supplied by the tank 295 through a system that includes a pump 296.

Finally, the cylinder blocks are delivered to a drying station 297 and after dried placed to a storage section 298 where they may be drawn from as may need be needed.

Thus, from the foregoing description it should be readily apparent that the described embodiments of the invention provide a very compact and effective plating line and one in which a wide variety of types of cylinder blocks may be plated with minimum change of tooling and thus minimum down time for switching from the plating of one type of cylinder block to other types.

Of course, the foregoing description is that of preferred embodiments of the invention and various changes and modifications may be made without departing from the spirit and scope of the invention, as defined by the appended claims.

What is claimed is:

1. A surface treatment device for applying a surface treatment employing a fluid to the cylinder bores of a wide variety of cylinder blocks having cylinder bores opening through one face thereof and having their cylinder bore axes spaced at a pitch dimension, said device being comprised of a base having fluid inlet port means for delivering the treatment fluid and fluid outlet port means for discharging the treatment fluid, at least one of said fluid port means being comprised of a plurality of ports and flow control means for selectively controlling the flow therethrough, the ports of said plurality extending through a base plate portion of said base, a detachable adapter plate adapted to be affixed in abutting relationship with said base plate and having a plurality of flow openings therein extending from an electrode receiving surface thereon to selected of said ports for enabling a flow therethrough, said fluid openings being spaced from each other in said electrode receiving surface in a pitch corresponding to the pitch between the cylinder bores of the cylinder blocks to be surface treated, and a cylinder block mounting plate fixed in spaced relationship to said adapter plate and adapted to support the one face of a cylinder block with the cylinder bores thereof in alignment with the flow openings in said electrode receiving surfaces, said mounting plate being formed with a number of openings equal to the number of cylinder bores formed in the supported cylinder block, said mounting plate openings being sized and configured to pass electrodes fixed to said adapter plate and to define a plurality of flow paths between the outer surface of the respective electrode and the adjacent cylinder bore for communication with the other of said base fluid port means.

2. A surface treatment device of claim 1, further including a plurality of electrodes affixed to the adapter plate and adapted to extend for substantially the full depth into the cylinder bores of the associated cylinder blocks.

3. A surface treatment device of claim 2, wherein the electrodes are tubular and define an area therebetween for receiving pellets of a material to be deposited on the cylinder bores of the cylinder blocks.

4. A surface treatment device of claim 3, wherein the outside diameter of the tubular electrodes is sufficient so as to be spaced closely from the respective cylinder bore of the cylinder blocks and wherein the inner diameter forms a flow path therethrough to one end of the cylinder bore.

5. A surface treatment device of claim 4, wherein the fluid control means effects flow in a path so that fluid is introduced through the inner tube of the respective electrode and is discharged from the area between the outer tube and the respective cylinder bore through the respective opening in the cylinder block mounting plate.

6. A surface treatment device of claim 1, wherein the adapter plate flow openings are angularly disposed so that the pitch center between the ends of the flow openings in the electrode receiving surface is different than the pitch spacing between the plurality of ports so as to accommodate cylinder bores of different pitch spacing by placement of the adapter plate.

7. A surface treatment device of claim 1, further including a plurality of flow conduits and valves therein for controlling the flow through selected of the flow openings and selected of the plurality of ports.

8. A surface treatment device of claim 1, further including fluid receiving tank into which the cylinder blocks are positioned and closed at an upper end thereof by a closure plate.

9. A surface treatment device of claim 8, wherein the cylinder blocks have ports extending from their cylinder bores to their exterior surfaces and which ports are open to the interior of the tank and further including a fixture carried by the closure plate and engaged with the cylinder block for holding the cylinder block in abutting relationship with the cylinder block mounting plate.

* * * * *